US006895631B1

(12) United States Patent
Krause et al.

(10) Patent No.: US 6,895,631 B1
(45) Date of Patent: May 24, 2005

(54) BUFFING PAD WEAR INDICATOR

(75) Inventors: Aaron C. Krause, Cherry Hill, NJ (US); Saul Denenberg, Blue Bell, PA (US)

(73) Assignee: Dedication to Detail, Inc., Folcroft, PA (US)

( * ) Notice: Subject to any disclaimer, the term of this patent is extended or adjusted under 35 U.S.C. 154(b) by 0 days.

(21) Appl. No.: 10/936,301

(22) Filed: Sep. 8, 2004

(51) Int. Cl.[7] ..... A47L 11/14
(52) U.S. Cl. ..... 15/230; 15/97.1; 15/97.3
(58) Field of Search ..... 15/230, 97.1, 97.3

(56) References Cited

U.S. PATENT DOCUMENTS

| | | | | |
|---|---|---|---|---|
| 5,733,176 | A | | 3/1998 | Robinson et al. |
| 6,090,475 | A | | 7/2000 | Robinson et al. |
| 6,106,661 | A | | 8/2000 | Raeder et al. |
| 6,136,043 | A | | 10/2000 | Robinson et al. |
| 6,390,908 | B1 | | 5/2002 | Chen et al. |
| 6,580,511 | B1 | | 6/2003 | Discenzo |
| 6,685,548 | B2 | | 2/2004 | Chen et al. |
| 2002/0189041 | A1 | * | 12/2002 | Duff et al. ..... 15/167.1 |
| 2004/0045581 | A1 | * | 3/2004 | Boomgaarden et al. ..... 134/6 |

* cited by examiner

*Primary Examiner*—Randall Chin
(74) *Attorney, Agent, or Firm*—Norman E. Lehrer

(57) ABSTRACT

A buffing pad that includes a substantially conventional buffing pad made of tufted wool that includes a backing plate and a central hub for attachment to the shaft of a rotary power buffer. The tufts or strands of wool are of a first and substantially equal length and of a substantially uniform color. The pad also carries a plurality of shorter tufts of wool or other fiber of a contrasting color. When the pad is relatively new, the shorter tufts are not normally visible as they are hidden by the longer tufts. As the pad becomes worn, however, the longer tufts become shorter and matted down thereby exposing the shorter tufts. The appearance of the contrasting color of the shorter tufts is an indicator that the pad is worn and should be replaced.

3 Claims, 2 Drawing Sheets

BUFFING PAD WEAR INDICATOR

BACKGROUND OF THE INVENTION

The present invention is directed toward a buffing pad and more particularly, toward a wool buffing pad that has its principal use in buffing an automobile and which is designed to indicate when the pad is wearing out and should be replaced.

Buffing pads for use in high speed polishing of automobiles and the like may be one-sided or two-sided. A one-sided buffing pad is typically circular and is attached to a rigid circular backing plate which is attached by a central hub to the shaft of a rotary power buffer. The pad may be permanently attached to the backing plate or releasably attached thereto in order to allow for replacement without disposing of the backing plate.

A two-sided pad includes a buffing pad attached to each face of a rigid backing plate. The plate includes a hub for releasably attaching the pad to the drive shaft or spindle of a high speed buffing motor. The pad may be attached to the motor from either side of the pad, thereby allowing the pad to be reversed after one side has been used.

Typically, such buffing pads are made from tufted wool or from other natural or synthetic fibers. It is also well known to make such pads from a foam material, for example, open cell polyurethane foam.

As the pads are used, however, there is no indication that the pad is wearing out. A worn pad clearly does not function as well as a new pad and can even cause damage to the automobile or other surface being polished.

U.S. Pat. No. 6,106,661 to Raeder et al. discloses various wear level indicators for polishing a pad. In one embodiment the wear level indicator may include means for measuring the thickness of the pad. As the pad is used and loses its desired thickness, the pad should be discarded. In another embodiment a color insert may be positioned within the pad. As the pad is used, the colored insert will be exposed thereby indicating that the pad should be discarded. This indicator device, however, is not used with wool buffing pads for automobiles.

U.S. Pat. No. 6,090,475 to Robinson et al. discloses a polishing pad with a wear indicator. The indicator includes a pad dyed with a particular color. The dye is not exposed in a new pad. As the pad is used, however, the pad wears away and the color is exposed thereby indicating that the pad has exceeded its level of usefulness and should be changed. This indicator device, however, is also not used with wool buffing pads for automobiles.

Therefore, a need exists for an indicator that signals that a wool buffing pad for a polishing the body of an automobile or similar surface is about to wear out so as to prevent any damage that may occur to the surface.

SUMMARY OF THE INVENTION

The present invention is designed to overcome the deficiencies of the prior art discussed above. It is an object of the present invention to provide a buffing pad for an automobile or the like that indicates that the pad is wearing out.

It is another object of the present invention to provide a buffing pad made primarily of wool or other natural or artificial fiber for use on an automobile or similar surface that indicates that the pad is wearing out.

In accordance with the illustrative embodiments demonstrating features and advantages of the present invention, there is provided a buffing pad that essentially includes a substantially conventional buffing pad made of tufted wool that includes a backing plate and a central hub for attachment to the shaft of a rotary power buffer. The tufts or strands of wool are of a first and substantially equal length and of a substantially uniform color. The pad also carries a plurality of shorter tufts of wool or other fiber of a contrasting color. When the pad is relatively new, the shorter tufts are not normally visible as they are hidden by the longer tufts. As the pad becomes worn, however, the longer tufts become shorter or matted down thereby exposing the shorter tufts. The appearance of the contrasting color is an indicator that the pad is worn and should be replaced.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
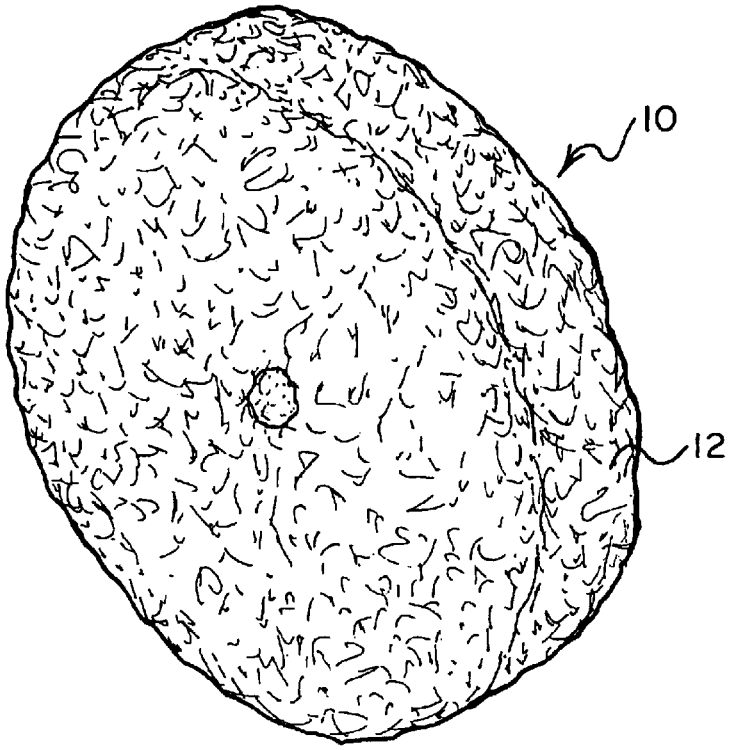
FIG. 1 is a front perspective view of a buffing pad of the invention in its new, unused or relatively unused state.

Referring now to the drawings in detail wherein like reference numerals have been used throughout the various figures to designate like elements, there is show in FIG. 1 a buffing pad constructed in accordance with the principles of the present invention and designated generally as 10.

Figure 3:
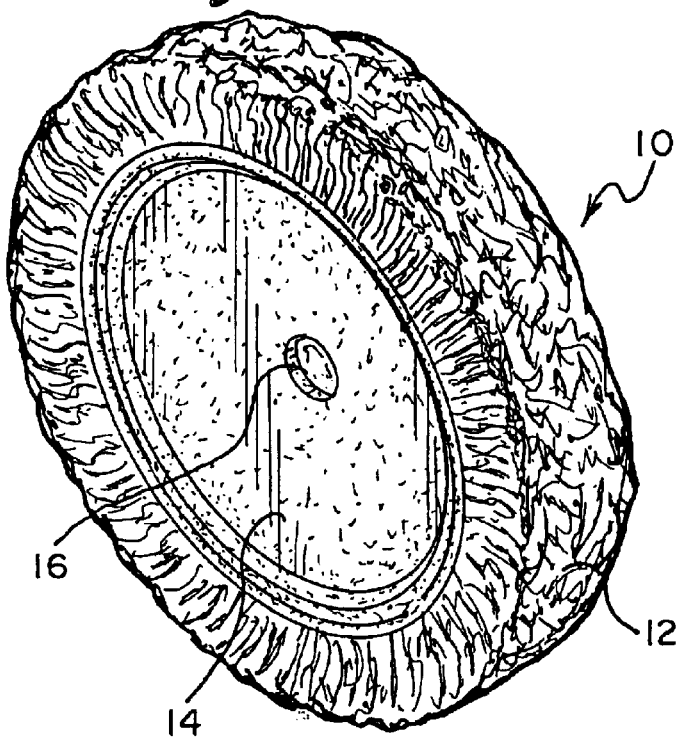
FIG. 3 is a rear perspective view of the buffing pad of the present invention as shown in FIG. 1.
Figure 5:
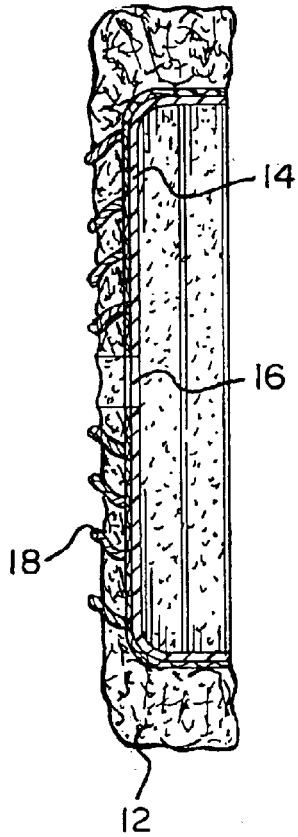
FIG. 5 is a cross-sectional view of the used buffing pad of FIG. 2.

The buffing pad 10 of the present invention is particularly useful for buffing or polishing an automobile and essentially includes a circular pad 12 of tufted wool. The tufted wool pad 12 is secured to a backing plate 14 as shown in FIG. 3 which includes a central hub 16 for attachment to the shaft of a rotary power buffer. The wool pad 12 is comprised of a plurality of tufts or strands of wool that extend outwardly from the inner surface of the pad which is attached to the backing plate 14.

The buffing pad just described is essentially of conventional construction. As is well known in the art, the lengths of the individual tufts of wool making up the pad cover 12 are substantially equal and have a length sufficient to provide the pad with its ability to buff the surface of an automobile or the like. The tufts are also of a substantially uniform color which is normally a relatively light color such as cream or off white or the like.

Figure 2:
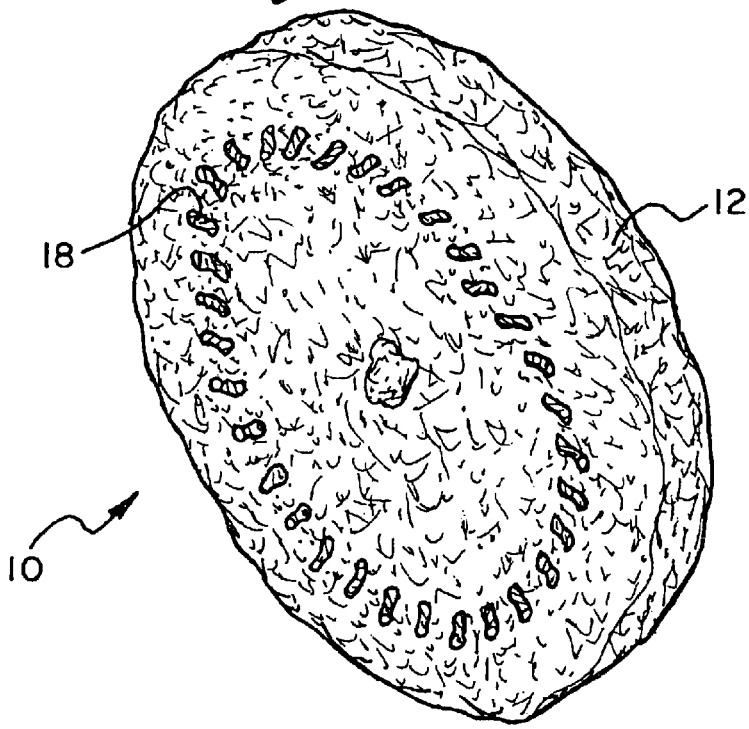
FIG. 2 is a front perspective view similar to FIG. 1 but showing the pad after it has been used for a period of time.
Figure 4:
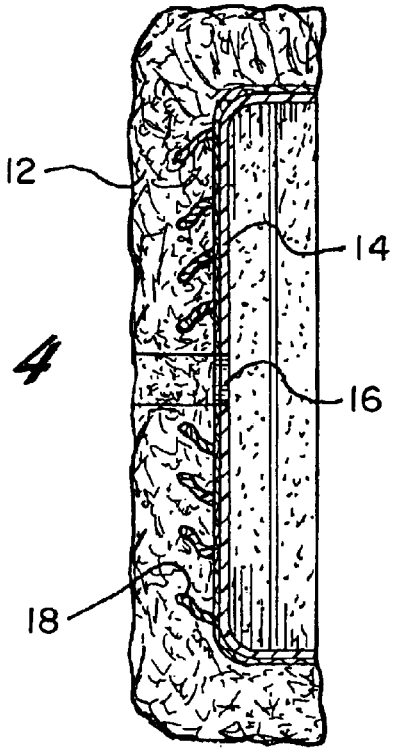
FIG. 4 is a cross-sectional view of the relatively new buffing pad of FIG. 1.

Embedded within the standard tufts of wool that make up the conventional pad 12 are a plurality of shorter tufts of wool 18 shown most clearly in FIG. 4. The shorter tufts 18 are of a contrasting and preferably darker color than the conventional tufts that make up the pad 12. There are also substantially fewer of the contrasting tufts 18 than the standard turfs. The shorter tufts 18 may be randomly located throughout the pad 12 or, preferably, are in a circular pattern, as shown in FIG. 2.

It is normal configuration when the pad 10 is relatively new, the contrasting colored tufts 18 are not visible as shown in FIG. 1. This is because the tufts 18 are shorter than the remaining tufts and are hidden beneath the outer surface of the pad by the larger quantity of the conventional tufts of wool. However, as the wool pad is utilized, the tufts of wool tend to get matted down. Even after the pad is washed, it remains somewhat matted and after several uses, the matting of the pad becomes significant. At this point, the shorter colored tufts 18 become visible as shown in FIG. 2. This is a clear indication to the user that the pad is worn and should be replaced.

In lieu of tufts of wool 18 of contrasting color, it should be readily apparent that other types of indicators could be used. For example, strands or threads of wool or substantially any other material that would not be harmful to the buffing process could be utilized in lieu of the tufts 18. These other strands or fibers would similarly be shorter than the wool tufts making up the pad 12. It may also be possible to color the bottom of some of the conventionally tufts with a contrasting color or to wrap a thread or the like of material around the lower portion of some of the conventional tufts. Furthermore, it is possible to make the pad 12, itself, out of material other than wool. Other natural fibers and/or artificial fibers may also be utilized. In any event, the pad will include colored elements below the surface that are normally not visible but which become visible when the pad becomes matted through use. All such variations are intended to be covered by the present invention.

Even further, it may be possible to utilize certain chemical agents that may be applied to or otherwise integrated with the fibers that make up the pad 12 and which are normally of essentially the same color as the pad but which are capable of changing color. That is, the chemicals may change to a contrasting color after substantial use of the pad. This can be caused by, for example, the repeated exposure to heat caused by several uses of the pad 10 in polishing an automobile.

The present invention may be embodied in other specific forms without departing from the spirit or essential attributes thereof and accordingly, reference should be made to the appended claims rather than to the foregoing specification as indicating the scope of the invention. By way of example, although it has been emphasized herein that the buffing pad of the present invention has particular use in buffing or polishing an automobile, it should be readily apparent to those skilled in the art that the inventive pad may be used for buffing or polishing numerous other surfaces that are customarily buffed by such pads.

We claim:

1. A buffing pad comprising:

a generally circular layer of wool material;

means for indicating said wool material is wearing out, said indicating means being embedded within said wool material; and means for securing the pad to a rotary power buffer.

2. The buffing pad of claim 1 wherein said indicating means includes a fiber embedded within said wool material, said fiber being visible only when said wool material has been worn down.

3. The buffing pad of claim 1 wherein said indicating means includes a thread sewn into said wool material, said thread being visible only when said wool material has been worn down.

* * * * *